US006571823B2

(12) United States Patent
Rossi et al.

(10) Patent No.: US 6,571,823 B2
(45) Date of Patent: Jun. 3, 2003

(54) METHOD AND DEVICE FOR ESTIMATING THE POSITION OF AN ACTUATOR BODY IN AN ELECTROMAGNETIC ACTUATOR TO CONTROL A VALVE OF AN ENGINE

(75) Inventors: Carlo Rossi, Bologna (IT); Alberto Tonielli, Imola (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/848,554

(22) Filed: May 4, 2001

(65) Prior Publication Data

US 2002/0014269 A1 Feb. 7, 2002

(30) Foreign Application Priority Data

May 4, 2000 (IT) ..... BO2000A0247

(51) Int. Cl.[7] ..... F16K 37/00; G01B 7/14

(52) U.S. Cl. ..... 137/554; 123/90.11; 324/207.16; 324/207.24

(58) Field of Search ..... 137/554; 123/90.11; 324/207.16, 207.17, 207.24

(56) References Cited

U.S. PATENT DOCUMENTS 4,809,742 A * 3/1989 Grau ..... 137/554
4,825,904 A * 5/1989 Grau et al. ..... 137/554
4,907,901 A * 3/1990 Mitchell ..... 324/207.16
5,523,684 A * 6/1996 Zimmermann ..... 324/207.2
5,727,591 A * 3/1998 Doll ..... 137/554
6,044,814 A 4/2000 Fuwa

FOREIGN PATENT DOCUMENTS

| | | |
|---|---|---|
| DE | 195 44 207 | 6/1997 |
| DE | 198 36 769 | 4/2000 |
| EP | 0 959 479 | 11/1999 |
| FR | 2 784 712 | 4/2000 |

* cited by examiner

*Primary Examiner*—John Rivell
(74) *Attorney, Agent, or Firm*—Venable LLP; Robert Kinberg; Chad C. Anderson

(57) ABSTRACT

Method and device for estimating the position of an actuator body in an electromagnetic actuator to control a valve of an engine, according to which the actuator body, which is at least partly made of ferromagnetic material, is displaced towards at least one electromagnet, by the effect of the force of electromagnetic attraction generated by the electromagnet itself; the position of the actuator body relative to the electromagnet is determined on the basis of the value assumed by the reluctance of a magnetic circuit constituted by the electromagnet and by the actuator body.

16 Claims, 3 Drawing Sheets

METHOD AND DEVICE FOR ESTIMATING THE POSITION OF AN ACTUATOR BODY IN AN ELECTROMAGNETIC ACTUATOR TO CONTROL A VALVE OF AN ENGINE

The present invention relates to a method for estimating the position of an actuator body in an electromagnetic actuator to control a valve of an engine.

BACKGROUND OF THE INVENTION

As is known, at present there are internal-combustion engines which are at the experimental stage, of the type described in Italian patent application B099A000443, filed on Aug. 4, 1999, in which the movement of the intake and exhaust valves is performed by electromagnetic actuators.

These electromagnetic actuators have undoubted advantages, in that they make it possible to control each valve according to an optimised law for any operative condition of the engine, whereas conventional mechanical actuators (typically cam shafts) require the definition of a profile of raising of the valves, which represents an acceptable compromise for all the possible conditions of operation of the engine.

An electromagnetic actuator for an internal-combustion engine of the above-described type normally comprises at least one electromagnet, which can displace an actuator body, which is made of ferromagnetic material, and is connected mechanically to the rod of the respective valve. In order to apply to the valve a particular law of motion, a control unit pilots the electromagnet with a current which is variable over a period of time, in order to displace the actuator body in an appropriate manner.

Experimental tests have shown that in order to obtain relatively high accuracy in the control of the valve, it is necessary to control the position of the actuator body with feedback; it is thus necessary to have an accurate reading, substantially in real time, of the position of the actuator body itself.

In electromagnetic actuators of the above-described type, the position of the actuator body is read by means of a laser sensor, which, however, is costly, delicate, and difficult to calibrate, and is therefore unsuitable for use in mass production.

SUMMARY OF THE INVENTION

The object of the present invention is to provide a method for estimating the position of an actuator body in an electromagnetic actuator to control a valve of an engine, which is free from the disadvantages described, and which in particular is easy and economical to implement.

According to the present invention, a method is provided for estimating the position of an actuator body in an electromagnetic actuator to control a valve of an engine, as described in claim 1.

The present invention also relates to a device for estimating the position of an actuator body in an electromagnetic actuator to control a valve of an engine.

According to the present invention, a device is provided for estimating the position of an actuator body in an electromagnetic actuator to control a valve of an engine, as described in claim 9.

BRIEF DESCRIPTION OF THE DRAWINGS

The present invention will now be described with reference to the attached drawings, which illustrate a non-limiting embodiment of it, in which.

DETAILED DESCRIPTION OF THE INVENTION

Figure 1:
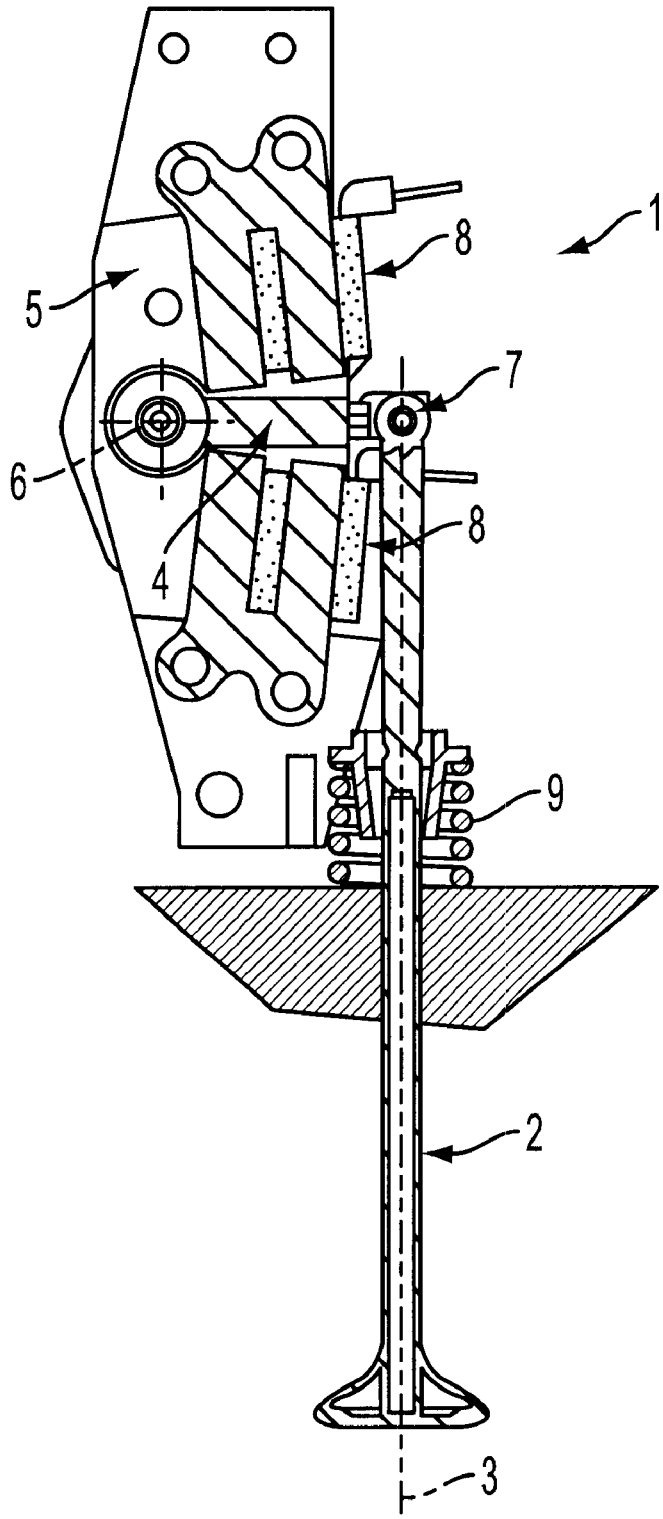
FIG. 1 is a schematic lateral elevated view, partially in cross-section, of a valve of an engine, and of a corresponding electromagnetic actuator which operates according to the method which is the subject of the present invention.

In FIG. 1, 1 indicates as a whole an electromagnetic actuator 1 (of the type described in Italian patent application B099A000443, filed on Aug. 4, 1999), connected to an intake or exhaust valve 2 of an internal combustion engine of a known type, in order to displace the valve 2 itself along a longitudinal axis 3 of the valve, between a position of closure (which is known and not illustrated), and a position of maximum opening (which is known and not illustrated).

The electromagnetic actuator comprises a small oscillating arm 4, made at least partially of ferromagnetic material, which has a first end pivoted on a support 5, such as to be able to oscillate around an axis 6 of rotation, perpendicular to the longitudinal axis 3 of the valve 2, and a second end connected by means of a hinge 7, to an upper end of the valve 2. The electromagnetic actuator 1 also comprises two electromagnets 8, which are supported in a fixed position by the support 5, such as to be disposed on opposite sides of the small oscillating arm 4, and a spring 9, which is connected to the valve 2, and can maintain the small oscillating arm 4 in an intermediate position (illustrated in FIG. 1), in which the small oscillating arm 4 itself is equidistant from the pole pieces 10 of the two electromagnets 8.

In use, the electromagnets 8 are controlled by a control unit 11, such as to exert alternately or simultaneously a force of attraction of magnetic origin on the small oscillating arm 4, in order to make it rotate around the axis 6 of rotation, consequently displacing the valve 2 along the respective longitudinal axis 3 and between the said positions of maximum opening and closure (not illustrated). In particular, the valve 2 is in the said position of closure (not illustrated) when the small oscillating arm 4 abuts the lower electromagnet 8, and it is in the said position of maximum opening (not illustrated) when the small oscillating arm 4 abuts the upper electromagnet 8, and it is in a position of partial opening when the two electromagnets 8 are both switched off, and the small oscillating arm 4 is in the said intermediate position (illustrated in FIG. 1), owing to the effect of the force exerted by the spring 9.

The control unit 11 controls the position of the small oscillating arm 4 with feedback, and in a substantially known manner, i.e. it controls the position of the valve 2, on the basis of the conditions of operation of the engine.

Figure 2:
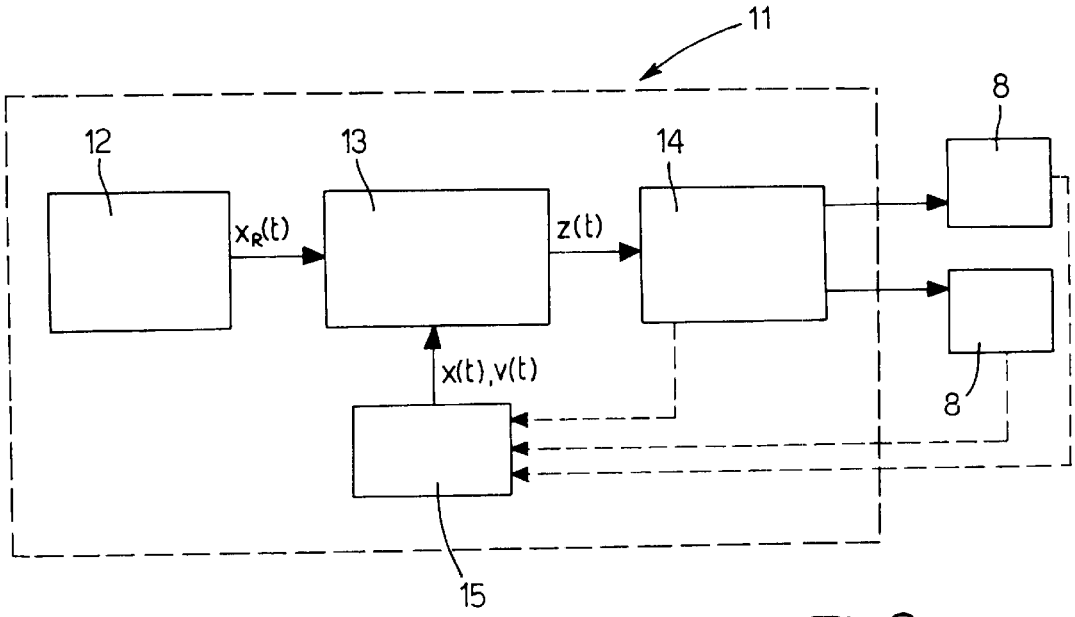
FIG. 2 is a schematic view of a control unit of the actuator in FIG. 1.

In particular, as illustrated in FIG. 2, the control unit 11 comprises a reference generation block 12, a calculation block 13, a piloting block 14 which can supply the electromagnets 8 with a current which is variable over a period of time, and an estimator block 15, which can estimate substantially in real time the position x(t) and the speed v(t) of the small oscillating arm 4.

In use, the reference generation block 12 receives as input a plurality of parameters which are indicative of the conditions of operation of the engine (for example the load, the number of revolutions, the position of the floating body, the angular position of the engine shaft, and the temperature of the cooling fluid), and supplies to the calculation block 13 an objective value $x_R(t)$ (i.e. a required value) of the position of the small oscillating arm 4 (and thus of the valve 2).

On the basis of the objective value $x_R(t)$ of the position of the small oscillating arm 4, and on the basis of the estimated value x(t) of the position of the small oscillating arm 4 received from the estimator block 15, the calculation block 13 processes and transmits to the piloting block 14 a control signal z(t), in order to pilot the electromagnets 8. According to a preferred embodiment, the calculation block 13 processes the control signal z(t) also on the basis of an estimated value v(t) of the speed of the small oscillating arm 4, received from the estimator block 15.

According to a different embodiment, not illustrated, the reference generation block 12 supplies to the calculation block either an objective value $x_R(t)$ of the position of the small oscillating arm 4, or an objective value $v_R(t)$ of the speed of the small oscillating arm 4.

Figure 3:
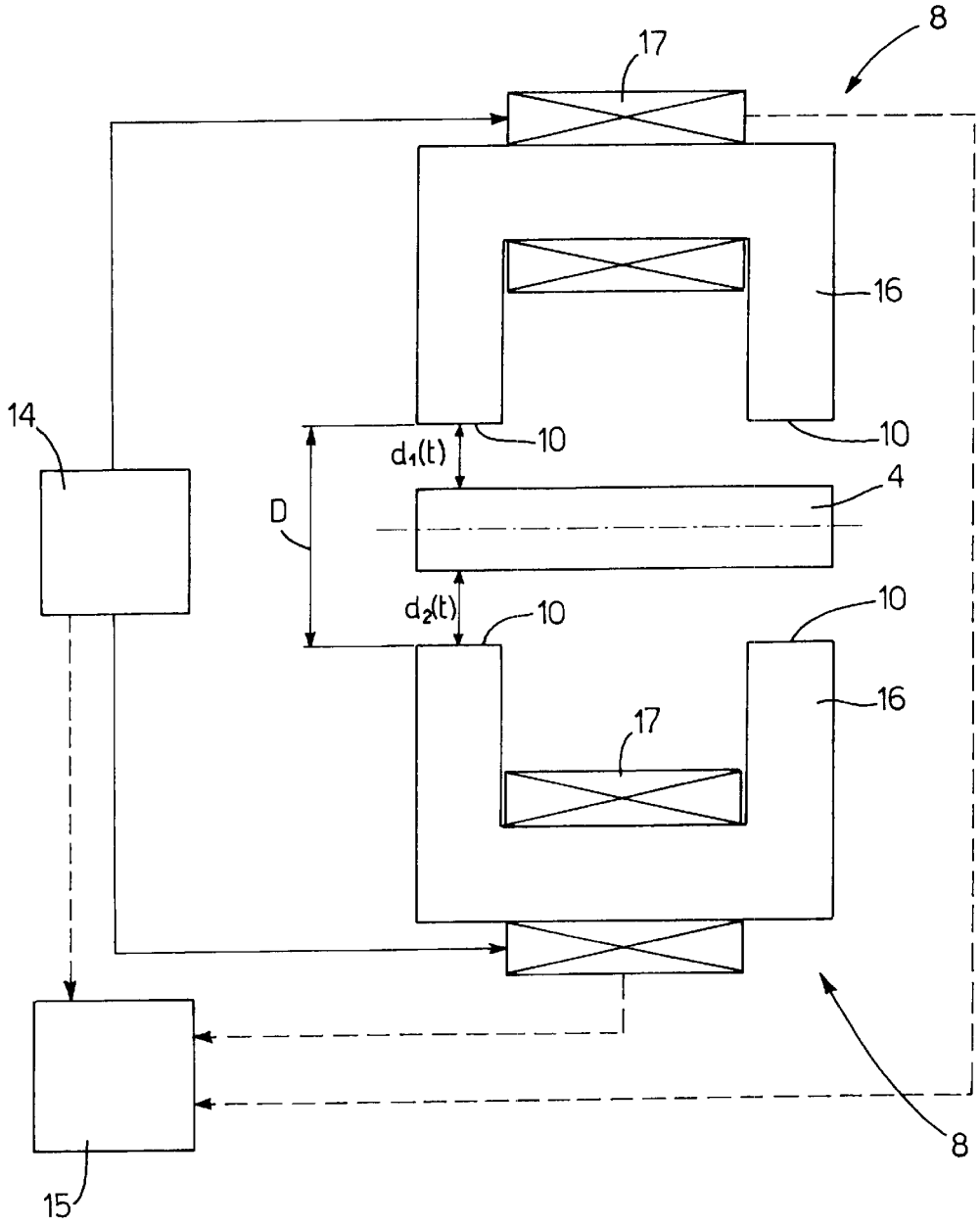
FIG. 3 illustrates schematically part of the control unit in FIG. 2.

As illustrated in FIG. 3, the piloting block 14 supplies power to the two electromagnets 8, each of which comprises a respective magnetic core 16 connected to a corresponding coil 17, in order to displace the small oscillating arm 4 on the basis of the commands received from the calculation block 13. The estimator block 15 reads the values, which are described in detail hereinafter, both of the piloting block 14 and of the two electromagnets 8, in order to calculate an estimated value x(t) of the position, and an estimated value v(t) of the speed of the small oscillating arm 4.

The small oscillating arm 4 is disposed between the pole pieces 10 of the two electromagnets 8, which are supported by the support 5 in the fixed position, and at a fixed distance D relative to one another, and thus the estimated value x(t) of the position of the small oscillating arm 4 can be determined directly by means of a simple operation of algebraic adding of an estimated value d(t) of the distance which exists between a specific point of the small oscillating arm 4, and a corresponding point of one of the two electromagnets 8. Similarly, the estimated value v(t) of the speed of the oscillating arm 4 can be determined directly from an estimated value of the speed which exists between a specific point of the small oscillating arm 4, and a corresponding point of one of the two electromagnets 8.

In order to calculate the value x(t), the estimator block 15 calculates the two values $d_1(t)$, $d_2(t)$ of the distance which exists between a specific point of the small oscillating arm 4, and a corresponding point of each of the two electromagnets 8; from the two estimated values $d_1(t)$, $d_2(t)$, the estimator block 15 determines two values $x_1(t)$, $x_2(t)$, which are generally different from one another, owing to the noise and the measurement errors. According to a preferred embodiment, the estimator block 15 produces an average of the two values $x_1(t)$, $x_2(t)$, optionally weighted on the basis of the accuracy attributed to each value x(t). Similarly, in order to calculate the value v(t), the estimator block 15 calculates the two estimated values of the speed which exists between a specific point of the small oscillating arm 4, and a corresponding point of each of the two electromagnets 8; from the two estimated values of the speed, the estimator block 15 determines two values $v_1(t)$, $v_2(t)$, which are generally different from one another, owing to the noise and the measuring errors.

According to a preferred embodiment, the estimator block 15 produces an average of the two values $v_1(t)$, $v_2(t)$, which is optionally weighted on the basis of the accuracy attributed to each value v(t).

Figure 4:
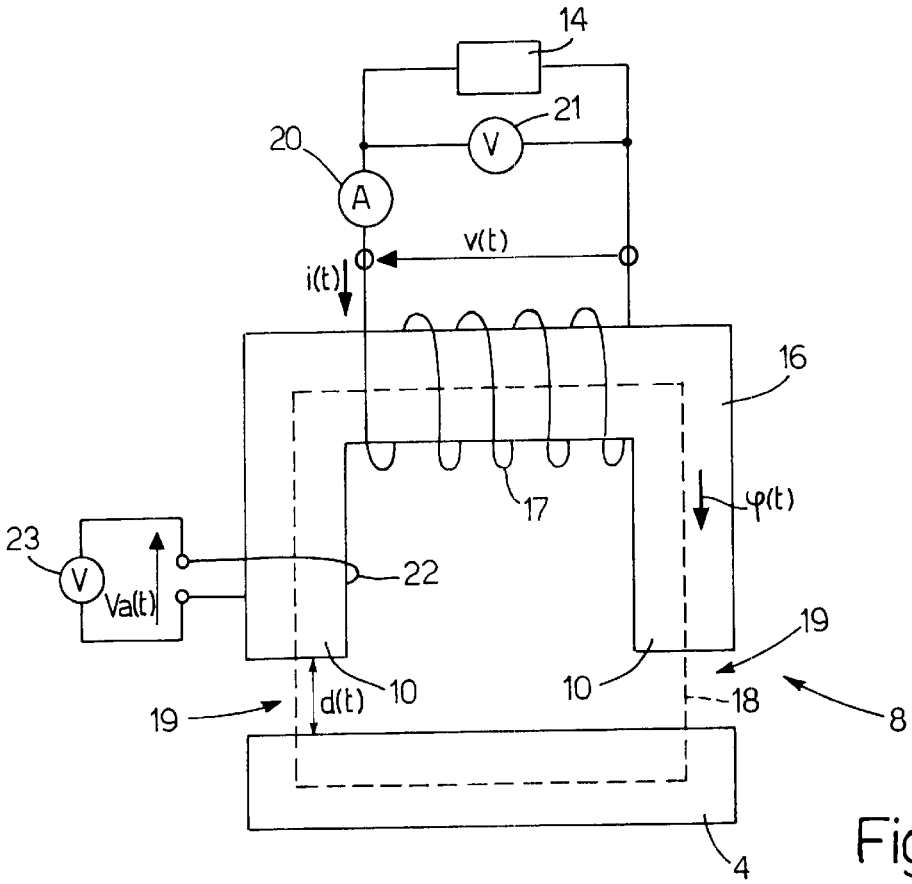
FIG. 4 illustrates a circuit diagram of a detail of FIG. 3.

With particular reference to FIG. 4, which illustrates a single electromagnet 8, a description is provided hereinafter of the methods used by the estimator block 15 in order to calculate an estimated value d(t) of the distance which exists between a specific point of the small oscillating arm 4, and a corresponding point of the electromagnet 8, and to calculate an estimated value of the speed which exists between a specific point of the small oscillating arm 4, and a corresponding point of the electromagnet 8.

In use, when the piloting block 14 applies a voltage v(t) which is variable over a period of time, to the terminals of the coil 17 of the electromagnet 8, a current i(t) passes through the coil 17 itself, consequently generating a flow $\phi(t)$ through a magnetic circuit 18 connected to the coil 17. In particular, the magnetic circuit 18 which is connected to the coil 17 consists of the core 16 made of ferromagnetic material of the electromagnet 8, the small oscillating arm 4 made of ferromagnetic material, and the gap 19 which exists between the core 16 and the oscillating arm 4.

The magnetic circuit 18 has an overall reluctance R which is defined by the sum of the reluctance of the iron $R_{fe}$ and the reluctance of the gap $R_o$; the value of the flow $\phi(t)$ which circulates in the magnetic circuit 18 is associated with the value of the current i(t) which circulates in the coil 17, by the following ratio (in which N is the number of turns of the coil 17):

$$N*i(t)=R*\phi(t)$$

$$R=R_{fe}+R_o.$$

In general, the value of the overall reluctance R depends both on the position x(t) of the small oscillating arm 4 (i.e. on the size of the gap 19, which, apart from a constant, is equivalent to the position x(t) of the small oscillating arm), and on the value assumed by the flow $\phi(t)$. Apart from negligible errors (i.e. in the first approximation), it can be considered that the value of the reluctance of the gap $R_{fe}$ depends only on the value assumed by the flow $\phi(t)$, whereas the value of the reluctance of the gap $R_o$ depends only on the position x(t), i.e.:

$$R(x(t),\phi(t))=R_{fe}(\phi(t))+R_o(x(t))$$

$$N*i(t)=R(x(t),\phi(t))*\phi(t)$$

$$N*i(t)=R_{fe}(\phi(t))*\phi(t)+R_o(x(t))*\phi(t)$$

By solving the last equation given above, relative to $R_o(x(t))$, it is possible to determine the value of the reluctance at the gap $R_o$, if the value of the current i(t) is known, which value can easily be measured by means of an ammeter 20, if the value of N is known (which is fixed and dependent on the structural characteristics of the coil 17), if the value of the flow $\phi(t)$ is known, and if the ratio is known which exists between the reluctance of the iron $R_{fe}$ and the flow $\phi$ (which is known from the structural characteristics of the magnetic circuit 18, and from the magnetic characteristics of the material used, or can easily be determined by means of experimental tests).

The ratio which exists between the reluctance at the gap $R_o$ and the position x can be determined relatively simply by analysing the characteristics of the magnetic circuit 18 (an example of a model of the behaviour of the gap 19 is represented by the equation given hereinafter). When the ratio between the reluctance at the gap $R_o$ and the position x is known, the position x can be determined from the reluctance at the gap $R_o$, by applying the inverse ratio (which is applicable either by using the exact equation, or by applying a methodology for approximate numerical calculation). The foregoing can be summarised in the following ratios (in which $H_{fe}(\phi(t))=R_{fe}(\phi(t))*\phi(t)$):

$$R_o(x(t)) = \frac{N \cdot i(t) - H_{fe}(\varphi(t))}{\varphi(t)}$$

$$R_o(x(t)) = K_1[1 - e^{-k_2 \cdot x(t)} + k_3 \cdot x(t)] + K_0$$

$$x(t) = R_0^{-1}(R_o(x(t))) = R_0^{-1}\left(\frac{N \cdot i(t) - H_{fe}(\varphi(t))}{\varphi(t)}\right)$$

The constants $K_0$, $K_1$, $K_2$, $K_3$ are constants which can be determined experimentally by means of a series of measurements on the magnetic circuit 18.

From the foregoing, it is apparent that if it is possible to measure the flow $\phi(t)$, it is possible to calculate the position x(t) of the small oscillating arm 4 relatively simply. In addition, starting from the value of the position x(t) of the small oscillating arm 4, it is possible to calculate the value of the speed v(t) of the small oscillating arm 4 itself, by means of a simple operation of shifting of the position x(t) over a period of time.

According to a first embodiment, the flow $\phi(t)$ can be calculated by measuring the current i(t) which circulates through the coil 17, by means of the ammeter 20 of a known type, by measuring the voltage v(t) applied to the terminals of the coil 17 by means of a voltmeter 21 of a known type, and by knowing the value of the resistance RES of the coil 17 (a value which can easily be measured). This method for measurement of the flow $\phi(t)$ is based on the following ratios (in which N is the number of turns of the coil 17):

$$\frac{d\varphi(t)}{dt} = \frac{1}{N} \cdot (v(t) - RES \cdot i(t))$$

$$\varphi(T) = \frac{1}{N} \cdot \int_0^T (v(t) - RES \cdot i(t))dt + \varphi(0)$$

The conventional instant 0 is selected such as to determine accurately the value of the flow $\phi(0)$ at the instant 0 itself; in particular, the instant 0 is normally selected within a time interval in which no current passes through the coil 17, and therefore the flow $\phi$ is substantially zero (the effect of any residual magnetisation is negligible), or the instant 0 is selected at a pre-determined position of the small oscillating arm 4 (typically when the small oscillating arm 4 abuts the pole pieces 10 of the electromagnet 8), at which the value of the position x is known, and thus the value of the flow $\phi$ is known.

The above-described method for calculation of the flow $\phi$ is quite accurate and fast (i.e. it is free from delays); however, this method gives rise to some problems caused by the fact that the voltage v(t) applied to the terminals of the coil 17 is normally generated by a switching amplifier which is integrated in the piloting block 14, and thus varies continuously between three values ($+V_{supply}$, 0, $-V_{supply}$) of which two ($+V_{supply}$ and $-V_{supply}$) have a value which is relatively high, and is therefore difficult to measure accurately without the help of relatively complex and costly measuring circuits. In addition, the above-described method for calculation of the flow $\phi(t)$ requires continual reading of the current i(t) which circulates through the coil 17, and continual knowledge of the value of the resistance RES of the coil 17, which value, as known, varies as the temperature of the coil 17 itself varies.

According to a different embodiment, there is connected to the magnetic core 16 an auxiliary coil 22 (which consists of at least one turn, and is generally provided with a number Na of turns), to the terminals of which a further voltmeter 23 is connected; since the terminals of the coil 22 are substantially open (the internal resistance of the voltmeter 23 is high enough to be able to be considered infinite, without however introducing significant errors), no current passes through the coil 22, and the voltage $v_a$ at its terminals depends only on the drift of the flow $\phi(t)$ over a period of time, such that it is possible to determine the flow by means of an operation of integration (as far as the value $\phi(0)$ is concerned, the considerations described above apply):

$$\frac{d\varphi(t)}{dt} = \frac{1}{Na} \cdot v_a(t)$$

$$\varphi(T) = \frac{1}{Na} \cdot \int_0^T v_a(t)dt + \varphi(0)$$

The use of reading of the voltage $v_a(t)$ of the auxiliary coil 22 makes it possible to avoid any type of measurements and/or estimates of electrical current and electrical resistance, in order to calculate the flow $\phi(t)$; in addition, the value of the voltage $v_a(t)$ is associated with the value of the voltage v(t) (apart from the dispersions) by the ratio:

$$v_a(t) = \frac{Na}{N} \cdot (v(t) - RES \cdot i(t))$$

such that, by providing a suitable number Na of turns of the auxiliary coil 22, it is possible to maintain the value of the voltage $v_a(t)$ within an interval which can be measured accurately, and relatively easily.

From the foregoing, it is apparent that by using the reading of the voltage $v_a(t)$ of the auxiliary coil 22, calculation of the value of the flow $\phi$ is more accurate, faster and simpler than the use of the reading of the voltage v(t) at the ends of the coil 17.

In the above description, two methods have been provided for estimating the drift of the flow $\phi(t)$ over a period of time. According to one embodiment, it is chosen to use only one method for calculation of the drift of the flow $\phi(t)$. According to a different embodiment, it is chosen to use both the methods for calculation of the drift of the flow $\phi(t)$ over a period of time, and to use an average (which is optionally weighted relative to the estimated accuracy) of the results of the two methods applied, or to use one result to check the other (if there is a significant discrepancy between the two results, it is probable that an error has been made in the estimations).

As well as to estimate the position x(t) of the small oscillating arm 4, the measurement of the flow $\phi(t)$ can be used by the control unit 11, in order to verify the value of the force f(t) of attraction exerted by the electromagnet 8 on the oscillating arm, in that:

$$f(t) = -\frac{1}{2} \cdot \frac{\partial R(x(t), \varphi(t))}{\partial x} \cdot \varphi^2(t)$$

$$f(t) = -\frac{1}{2} \cdot \frac{\partial R_0(x(t))}{\partial x} \cdot \varphi^2(t)$$

In addition, according to a different embodiment, not illustrated, the control unit 11 controls with feedback the value of the flow $\phi(t)$ such that measurement of the flow $\phi(t)$ is essential in order to be able to carry out this type of control of the flow $\phi(t)$ (normally, the control with feedback of the value of the flow $\phi(t)$ is applied as an alternative to the control with feedback of the value of the current i(t) which circulates in the coil 17).

Finally, it should be noted that the above-described methods for estimating the position x(t) can be used only when current passes through the coil 17 of an electromagnet 8. For this reason, as previously explained, the estimator block 15 operates with both the electromagnets 8, such as to use the estimation carried out with one electromagnet 8, when the other is switched off. When both the electromagnets 8 are active, the estimator block 15 produces an average of the two values x(t) calculated with the two electromagnets 8, which is optionally weighted on the basis of the accuracy attributed to each value x(t) (generally the estimation of the position x carried out relative to an electromagnet 8 is more accurate when the small oscillating arm 4 is relatively close to the pole pieces of the electromagnet 8 itself).

What is claimed is:

1. A method for estimating the position (x) of an actuator body in an electromagnetic actuator to control a valve of an engine, the actuator body being at least partly made of ferromagnetic material, the method comprising:

displacing the actuator body towards at least one electromagnet by electromagnetic attraction generated by the electromagnet; and determining the position (x) of the actuator body relative to the electromagnet from the value of the overall reluctance (R) of a magnetic circuit, the circuit including the electromagnet and the actuator body.

2. A method according to claim 1, wherein, in the determining step, the overall reluctance (R) is assumed to consist of the sum of a first reluctance ($R_o$) caused by a gap in the magnetic circuit and a second reluctance ($R_{fe}$) caused by the ferromagnetic material of the magnetic circuit; the first reluctance ($R_o$) depending on structural characteristics of the magnetic circuit and on the value of the position (x), and the second reluctance ($R_{fe}$) depending on the structural characteristics of the magnetic circuit and on the value of a magnetic flow (ϕ) which passes through the magnetic circuit; and the position (x) being determined from the value assumed by the first reluctance ($R_o$).

3. A method according to claim 2, wherein the determining step includes calculating the value of the overall reluctance (R) of the magnetic circuit as the ratio between the value of a current (i) which circulates through a coil of the said electromagnet and a value of the magnetic flow (ϕ) which passes through the magnetic circuit; calculating the value of the said second reluctance ($R_{fe}$) according to the value of the magnetic flow (ϕ); and calculating the value of the first reluctance ($R_o$) as the difference between the value of the overall reluctance (R) and the value of the second reluctance ($R_{fe}$).

4. A method according to claim 2, wherein, in the determining step, a first mathematical ratio is defined, which expresses the value of the first reluctance ($R_o$), according to the value of the said position (x); the position (x) being determined by estimating a value of the first reluctance ($R_o$) and applying to the value of the first reluctance ($R_o$) the operation of inversion of the said first mathematical ratio.

5. A method according to claim 4, wherein the determining step includes defining the first mathematical ratio by the equation:

$$R_o(x(t))=K_1[1-e^{-k_2\cdot x(t)}+k_3\cdot x(t)]+K_0$$

in which $R_o$ is the said first reluctance ($R_o$), x(t) is the said position (x), and $K_0$, $K_1$, $K_2$, $K_3$ are four constants.

6. A method according to claim 2, wherein the determining step includes estimating the value of the magnetic flow (ϕ) by measuring the value of electrical quantities (i, v; $v_a$) of an electric circuit connected to the magnetic circuit, by calculating the drift over a period of time of the magnetic flow (ϕ) as a linear combination of the values of the electrical quantities (i, v; $v_a$), and by integrating over a period of time the drift of the magnetic flow (ϕ).

7. A method according to claim 6, wherein the determining step further includes measuring the current (i) which circulates through a coil of the electromagnet and the voltage (v) applied to the terminals of the coil; and calculating the drift over a period of time of the magnetic flow (ϕ) and the magnetic flow (ϕ) by applying the following formulae $$\frac{d\varphi(t)}{dt}=\frac{1}{N}\cdot(v(t)-RES\cdot i(t))$$

$$\varphi(T)=\frac{1}{N}\cdot\int_0^T(v(t)-RES\cdot i(t))dt+\varphi(0)$$

in which

ϕ is the magnetic flow (ϕ),

N is the number of turns of the coil, v is the voltage (v) applied to the terminals of the coil, RES is the resistance of the coil, and i is the current (i) which circulates through the coil.

8. A method according to claim 6, wherein an auxiliary coil having terminals is connected to the magnetic circuit and concatenates the magnetic flow (ϕ), and wherein, in the determining step, the voltage ($v_a$) present at the terminals of the auxiliary coil is measured, the auxiliary coil being substantially open electrically; the determining step including calculating the drift over a period of time of the magnetic flow (Φ) and the magnetic flow (ϕ) by applying the following formulae:

$$\frac{d\varphi(t)}{dt}=\frac{1}{Na}\cdot v_{aus}(t)$$

$$\varphi(T)=\frac{1}{Na}\cdot\int_0^T v_{aus}(t)dt+\varphi(0)$$

in which:

ϕ is the magnetic flow (ϕ), $N_a$ is the number of turns of the auxiliary coil, and $v_a$ is the voltage ($v_a$) present at the terminals of the auxiliary coil.

9. A method for estimating the position (x) of an actuator body in an electromagnetic actuator to control a valve of an engine, the actuator body being at least partly made of ferromagnetic material, the method comprising:

displacing the actuator body towards at least one electromagnet by electromagnetic attraction generated by the electromagnet; and determining the position (x) of the actuator body relative to the electromagnet from the value of the overall reluctance (R) of a magnetic circuit, the magnetic circuit including the electromagnet and the actuator body, the overall reluctance (R) being assumed to consist of the sum of a first reluctance ($R_o$) caused by a gap in the magnetic circuit, and a second reluctance ($R_{fe}$) caused by the ferromagnetic material of the magnetic circuit, the first reluctance ($R_o$) depending on structural characteristics of the magnetic circuit and on the value of the position (x), and the second reluctance ($R_{fe}$) depending on the structural characteristics of the magnetic circuit and on a value of a magnetic flow (ϕ) which passes through the magnetic circuit and the position (x) being determined on the basis of the value assumed by the first reluctance ($R_o$).

10. A method according to claim 9, wherein the determining step includes calculating the value of the overall reluctance (R) of the magnetic circuit as the ratio between the value of a current (i) which circulates through a coil of the said electromagnet and a value of the magnetic flow (ϕ) which passes through the magnetic circuit; calculating the value of the second reluctance ($R_{fe}$) according the value of the magnetic flow (ϕ); and calculating the value of the first reluctance ($R_o$) as the difference between the value of the overall reluctance (R) and the value of the second reluctance ($R_{fe}$).

11. A method according to claim 9, wherein, in the determining step, a first mathematical ratio is defined, which expresses the value of the first reluctance ($R_o$) according the value of the position (x); the position (x) being determined by estimating a value of the first reluctance ($R_o$), and applying to the value of the first reluctance ($R_o$) the operation of inversion of the said first mathematical ratio.

12. A method according to claim 11, wherein the determining step includes defining the first mathematical ratio by the equation:

$$R_o(x(t))=K_1[1-e^{-k^2\cdot x(t)}+k_3\cdot x(t)]+K_0$$

in which $R_o$ is the first reluctance ($R_o$), x(t) is the position (x), and $K_0$, $K_1$, $K_2$, $K_3$ are four constants.

13. A method according to claim 9, wherein the determining step includes estimating the value of the magnetic flow (ϕ) by measuring the value of electrical quantities (i, v; $v_a$) of an electric circuit connected to the magnetic circuit, by calculating the drift over a period of time of the magnetic flow (p) as a linear combination of the values of the electrical quantities (i, v; $v_a$), and by integrating over a period of time the drift of the magnetic flow (v).

14. A method according to claim 13, wherein the determining step includes measuring the current (i) which circulates through a coil of the electromagnet and the voltage (v) applied to the terminals of the coil; and calculating the drift over a period of time of the magnetic flow (ϕ) and the magnetic flow (ϕ) by applying the following formulae:

$$\frac{d\varphi(t)}{dt}=\frac{1}{N}\cdot(v(t)-RES\cdot i(t))$$

$$\varphi(T)=\frac{1}{N}\cdot\int_0^T(v(t)-RES\cdot i(t))dt+\varphi(0)$$

in which:

ϕ is the magnetic flow (ϕ),

N is the number of turns of the coil, v is the voltage (v) applied to the terminals of the coil, RES is the resistance of the coil, and i is the current (i) which circulates through the coil.

15. A method according to claim 13, wherein an auxiliary coil having terminals is connected to the magnetic circuit and concatenates the magnetic flow (ϕ), and wherein, in the determining step, the voltage ($v_a$) present at the terminals of the auxiliary coil is measured, the auxiliary coil being substantially open electrically; and the determining step including calculating the drift over a period of time of the magnetic flow (Φ) and the magnetic flow (ϕ) by applying the following formulae:

$$\frac{d\varphi(t)}{dt}=\frac{1}{Na}\cdot v_{aus}(t)$$

$$\varphi(T)=\frac{1}{Na}\cdot\int_0^T v_{aus}(t)dt+\varphi(0)$$

in which:

ϕ is the magnetic flow (ϕ),

Na is the number of turns of the auxiliary coil, and $v_a$ is the voltage ($v_a$) present at the terminals of the auxiliary coil.

16. A method for estimating the position (x) of an actuator body in an electromagnetic actuator to control a valve of an engine, the actuator body being at least partly made of ferromagnetic material, the method comprising:

displacing the actuator body towards at least one electromagnet by electromagnetic attraction generated by the electromagnet; and determining the position (x) of the actuator body relative to the electromagnet from value of the overall reluctance (R) of a magnetic circuit, the magnet circuit including the electromagnet and the actuator body, the said overall reluctance (R) being assumed to consist of the sum of a first reluctance (Ro) caused by a gap in the magnetic circuit and a second reluctance ($R_{fe}$) caused by the ferromagnetic material of the magnetic circuit, the first reluctance ($R_o$) depending on structural characteristics of the magnetic circuit and on the value of the position (x), and the second reluctance ($R_{fe}$) depending on the structural characteristics of the magnetic circuit and on a value of a magnetic flow (ϕ) which passes through the magnetic circuit, the position (x) being determined on the basis of the value assumed by the first reluctance ($R_o$), the value of the magnetic flow (ϕ) being estimated by measuring the value of electrical quantities (i, v; $v_a$) of an electric circuit connected to the magnetic circuit, by calculating the drift over a period of time of the magnetic flow (ϕ) as a linear combination of the values of the electrical quantities (i, v: $v_a$), and by integrating over a period of time the drift of the magnetic flow (ϕ), wherein an auxiliary coil having terminals is connected to the magnetic circuit and concatenates the magnetic flow (ϕ), and wherein, in the determining step, the voltage ($v_a$) present at the terminals of the auxiliary coil is measured, the auxiliary coil being substantially open electrically; the determining step including calculating the drift over a period of time of the magnetic flow (Φ) and the magnetic flow (ϕ) itself being calculated by applying the following formulae:

$$\frac{d\varphi(t)}{dt}=\frac{1}{Na}\cdot v_{aus}(t)$$

$$\varphi(T)=\frac{1}{Na}\cdot\int_O^T v_{aus}(t)dt+\varphi(0)$$

in which:

ϕ is the magnetic flow (ϕ),

Na is the number of turns of the auxiliary coil, and $v_a$ is the voltage ($v_a$) present at the terminals of the auxiliary coil.

* * * * *